US007564987B2

(12) United States Patent
Aeschlimann et al.

(10) Patent No.: US 7,564,987 B2
(45) Date of Patent: Jul. 21, 2009

(54) SET AND METHOD FOR PRODUCING A HEARING AID AND HEARING AID PRODUCED ACCORDING TO THIS METHOD

(75) Inventors: Marcel Aeschlimann, Ligerz (CH); Antonino Lanci, Bern (CH); Jean-Claude Frély, Bienne (CH); Jürg Clavadetscher, Ortschwaben (CH)

(73) Assignee: Bernafon AG, Bern (CH)

( * ) Notice: Subject to any disclaimer, the term of this patent is extended or adjusted under 35 U.S.C. 154(b) by 468 days.

(21) Appl. No.: 10/534,350

(22) PCT Filed: Sep. 26, 2003

(86) PCT No.: PCT/CH03/00642

§ 371 (c)(1),
(2), (4) Date: Oct. 14, 2005

(87) PCT Pub. No.: WO2004/045245

PCT Pub. Date: May 27, 2004

(65) Prior Publication Data

US 2006/0104467 A1 May 18, 2006

(30) Foreign Application Priority Data

Nov. 13, 2002 (CH) ..... 1907/02

(51) Int. Cl.
*H04R 25/00* (2006.01)

(52) U.S. Cl. ..... 381/322; 381/328

(58) Field of Classification Search ..... 381/72, 381/322, 324, 328, 380; 181/129, 130, 132, 181/135; 264/134, 135, 161, 222
See application file for complete search history.

(56) References Cited

U.S. PATENT DOCUMENTS

| | | | | |
|---|---|---|---|---|
| 5,321,757 | A | 6/1994 | Woodfill, Jr. | |
| 5,530,763 | A * | 6/1996 | Aebi et al. | 381/322 |
| 6,097,826 | A * | 8/2000 | Clavadetscher et al. | 381/324 |
| 6,249,587 | B1 * | 6/2001 | Clavadetscher et al. | 381/322 |

FOREIGN PATENT DOCUMENTS

| | | |
|---|---|---|
| EP | 0 821 541 A2 | 1/1998 |
| EP | 0 821 542 A2 | 1/1998 |
| EP | 0 821 543 A2 | 1/1998 |
| GB | 2 203 379 A | 10/1988 |

* cited by examiner

*Primary Examiner*—Brian Ensey
(74) *Attorney, Agent, or Firm*—Kenyon & Kenyon LLP

(57) ABSTRACT

A hearing aid includes a shaped body that is adapted to an individual auditory canal. A casting cavity is created from a central casting space element, an outer casting space element, and a canal element. The casting cavity is filled while inside the auditory canal. The central casting space element, which remains on the hearing aid, has an outer and an inner ring as well as a tubular and extendible membrane. The outer casting space element delimits the casting cavity on the outer face. After casting, the outer casting space element is replaced by an electronics module including a loudspeaker. The at least partly flexible canal element can hold the loudspeaker canal open, can be joined in a fixed or detachable manner to the outer casting space element, and can essentially close the opening of the inner ring and can limit the axial mobility of the inner ring.

19 Claims, 6 Drawing Sheets

SET AND METHOD FOR PRODUCING A HEARING AID AND HEARING AID PRODUCED ACCORDING TO THIS METHOD

CROSS-REFERENCE TO RELATED APPLICATIONS

This is a 371 national phase application of PCT/CH2003/000642 filed 26 Sep. 2003, claiming priority to Swiss Patent Application No. 1907/02 filed 13 Nov. 2002, the contents of which are incorporated herein by reference.

BACKGROUND OF THE INVENTION

1. Field of the Invention

The invention lies in the field of hearing aids and relates to a set, to a method and to a hearing aid. The set and the method according to the invention serve for manufacturing the hearing aid. The hearing aid belongs to the genus of hearing aids which are worn at least partly in the auditory canal and which in a preliminary condition have a casting cavity and which by way of filling the casting cavity in an auditory canal are adapted to this auditory canal. The hearing aid according to the invention in its definitive condition thus comprises a cast shape body which is adapted in an exact manner to the auditory channel of the user. The hearing aid according to the invention is preferably an aid for hearing, a radio receiver device or a device with another acoustic function. The hearing aid according to the invention may however merely have a protective function, which means for example that it may be a protective plug against noise or water.

2. Description of the Related Art

Hearing aids of the mentioned type are for example described in the publications EP-0821541 (or U.S. Pat. No. 6,249,587), EP-0821542 (or U.S. Pat. No. 6,097,826) or EP-0821543 (or U.S. Pat. No. 6,052,473). The hearing aids described in these publications have an expandable membrane which extends over the peripheral surface of the device and which is fastened on an outer end-plate and on the loudspeaker forming the inner end-face or on a ring holding the loudspeaker. The end-plate, membrane and loudspeaker essentially delimit the casting cavity, or the shape body which is cast therein. The electronics components of the device are at least partly cast in the shape body in a quasi floating manner and in a manner such that their relative positions to a certain extent are likewise adapted to the shape of the individual auditory canal. For the casting procedure a casting template which is provided for the supply of the casting mass and the bleeding of the casting cavity is placed on the end-plate, and where appropriate a positioning attachment for the exact positioning of the innermost part of the hearing aid in the auditory canal is placed on the inner end-face. After the casting procedure, the casting template and the positioning attachment are removed, by which means the hearing aid is essentially completed and may be worn immediately.

SUMMARY OF THE INVENTION

The problems which are to be solved, in particular when developing hearing aids of the mentioned type, are the problems of the miniaturisation (in particular for aids which are to be worn completely in the auditory canal and which have a diameter of less than 12 mm and a length of less than 25 mm) and problems of the safety of the casting procedure which is to be able to be carried out in the auditory canal of the person who is to wear the aid (wearer). Furthermore the device after the casting procedure is to be in an essentially wearable condition in a manner such that that without further processing or at the most, after a few simple hand manipulations, it may be transferred to the wearer. Despite this it should be able to also fulfil the conditions with regard to the functional adaptation to the requirements of the wearer. It should provide a large wearing comfort and it should be able to be manufactured within an economically acceptable framework.

With the hearing aids according to the state of the art, the mentioned problems and wishes are dealt with or fulfilled in various manners. The aids according to the above-mentioned publications fulfil the demands of miniaturisation, minimal finishing and wearing comfort in an excellent manner. The casting safety in the distal (inner) region of the aid is satisfactory. The electronics components for the adaptation to the auditory canal must be manipulated and are subjected to the casting procedure, by which means they may become damaged. The cast shape body and the electronics components are rigidly connected to one another in the finished device. In other words this means that if an electronics part is damaged by the casting procedure, if a faulty shape body is cast in a casting procedure, or if with the finished device, it is ascertained that the selected electronics is not optimal for the wearer, the complete hearing aid needs to be replaced. The device may not be repaired. This all has a negative effect with regard to the economics.

It is then the object of the invention to provide a hearing aid which is to be worn at least partly in the auditory canal, which in a preliminary condition comprises a casting cavity and in a definitive condition adapted to a specific auditory canal comprises a shape body with an individual shape which is cast in the casting cavity. The hearing aid is to be able to fulfil the demands with regard to the miniaturisation, safety, direct availability, functional adaptability, wearing comfort, reparability and economics at least as well as, or even better that known hearing aids of the same type. The object of the invention is furthermore the provision of a set and a method for manufacturing the hearing aid.

These objects are achieved by the set, the method and the hearing aid which is manufactured from the set according to the method.

The hearing aid according to the invention in its preliminary condition consists of two or three elements (central and outer casting space element and where appropriate separate channel element). In this condition it has none of the components which serve for the acoustic functioning (in particular none of the electronics ones). The two or three elements are connected to one another by way of simple releasable connections, in particular positive-fit snap connections. They define the casting cavity, provide the preliminary device with a sufficient stability for the introduction into the auditory canal and are at least partly deformable (bendable) for a first coarse adaptation to the auditory canal. The outer casting space element and where appropriate the separate channel element are removed from the shape body cast in the casting cavity, wherein the outer casting space element is replaced by a standardised, where appropriate limitedly deformable electronics module. The electronics module at the same time is fastened on the shape body with the same releasable connection as the removed, outer casting space element.

If the hearing aid is not to be equipped for an acoustic function, another module which has essentially the same shape as the electronics module but which for example serves for a passive protective function and is accordingly designed, takes the place of the electronics module.

The central casting space element has an inner and an outer ring which are connected to one another by way of a flexible-tube-like expandable membrane. The membrane thanks to its expandability forms a peripheral surface of the device which may be adapted to an auditory canal. The two rings determine essentially the shape of the inner and outer end-face of the device.

The outer casting space element its adapted in shape to the outer ring of the central casting space element. In the casting space it essentially keeps the space for the electronics module free and comprises an opening (casting opening) for pressing in the casting mass and where appropriate a bleeding opening.

For keeping free a loudspeaker channel in the cast shape body and for defining the axial length of the device, at least one partly bendable channel element is provided which in the preliminary device extends from the inner side of the outer casting space element to the inner ring of the central casting space element. The channel element in its end region is releasably or firmly connected to the inner side of the outer casting space element, and in its other end region is adapted to the inner ring of the central casting space element and is advantageously releasably connected to this, in a manner such that it essentially closes the opening of the element and delimits its axial movement ability. On account of the flexibility of the channel element, the loudspeaker channel which is kept free obtains a shape which as the case may be is bent and which is adapted to the individual auditory canal, wherein the adapted (bent) part of the channel in the finished device lies either between the output side of the loudspeaker or the inner end-face of the device, or between the input side of the loudspeaker or the outer end-face of the device.

The electronics module is based on an outer end-plate and where appropriate comprises a housing of which the end-plate forms a part. It contains all the components serving the acoustic functioning (e.g. microphone, amplifier, loudspeaker, receiver coil, battery compartment and suitable wiring). The loudspeaker is accommodated in the electronics module in a manner such that its output side is directed away from the end plate. Where appropriate the loudspeaker is arranged on a continuation of the electronics modules, wherein the continuation is bendable in a manner such that the alignment of the loudspeaker relative to the rest of the electronics module is variable in a limited manner. In place of the electronics module or additionally to this, one may provide another module which may be applied in the cast shape body of the device instead of the electronics module and for this, at least in the region of its inner side directed towards the shape body, it is adapted in shape to the outer casting space element and where appropriate to the channel element.

Advantageously cooperating, elastic positive fit means are arranged on the outer ring of the central casting space element as well as on the outer casting space element or on the electronics module or other module, with whose help the outer casting space element or the electronics module or the other module may be snapped on the central casting space element and may also be removed again. Such positive-fit means are advantageously provided on the inner ring of the central casting space element and on the channel element or on a cerumen protection cap which may be placed onto the inner end-face of the definitive device.

The set for manufacturing the hearing aid comprises at least the above-described two or three elements and the electronics module or other module. The method for manufacturing the hearing aid from the set is carried out with the following steps which are characterised by their simplicity:

combining the central casting space element, outer casting space element and where appropriate the separate channel element into the preliminary hearing aid (snapping together);

positioning the preliminary hearing aid in the auditory canal of the wearer and at the same time adapting it to the auditory canal by way of bending the channel element with respect to the relative position of the inner and outer end-face;

pressing the casting mass into the casting cavity and waiting for the casting mass to cure;

removing the hearing aid with the cast body from the auditory canal;

removing the outer casting space element and where appropriate the separate channel element and placing (snapping-in) the electronics module or other module at the location of the outer casting space element casting mass, by which means the hearing aid is ready for wearing.

The main advantages of the hearing aid according to the invention lie in its simple manufacture or individualisation and in the fact that the individualised part (only central casting space element with the cast shape body) and the functional part (electronics module) may be put together and separated again in an extremely simple way and manner. By way of this it becomes possible to individually exchange the one or the other part, and it becomes possible to try out the hearing aid in its finished shape with differently equipped electronics modules and to be able to adapt it better to the wishes and requirements of the wearer. The hearing aid may be repaired and despite this may not only be adapted to the specific auditory canal with regard to the shape of its peripheral surface, but also with regard to the relative positions of the inner and outer end-face.

BRIEF DESCRIPTION OF THE DRAWINGS

The set and the method according to the invention as well as various embodiments of the hearing aid according to the invention are described in more detail by way of the subsequent figures. With this, there are shown in.

DETAILED DESCRIPTION OF THE EMBODIMENTS

Objects and advantages of the present invention will become apparent from the following detailed description.

Figure 1:
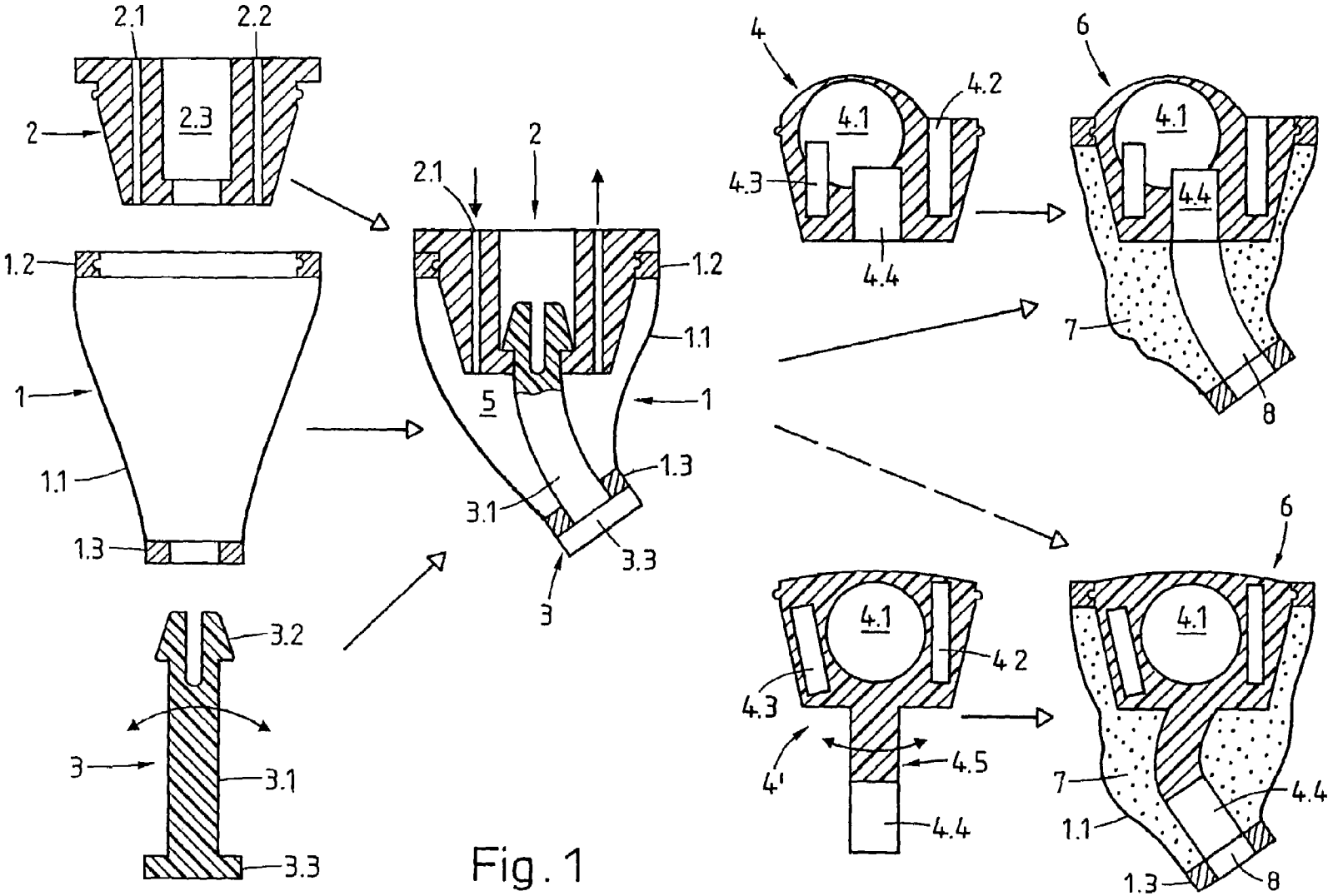
FIG. 1 a schematic diagram of the manufacture of two exemplary embodiments of the hearing aid according to the invention from a set with three elements and one electronics module (all sectioned parallel to the axis)

FIG. 1 shows very schematically the manufacture of the hearing aid according to the invention from a set which consists essentially of a central casting space element 1, of an outer casting space element 2, of a separate channel element 3 and of an electronics module 4 or 4'. The casting space elements 1 and 2 and the channel element 3 are shown to the very left in the FIG. 1 above one another. With this, one may recognise the flexible-tube-like membrane 1.1, the outer ring 1.2 and the inner ring 1.3 on the central casting space element; the casting opening 2.1, the bleeding opening 2.2 and a connection means 2.3 (e.g. an inwardly narrowing opening) on the outer casting space element 2; the middle, bendable part 3.1, the first end region 3.2 (e.g. elastically compressible head piece) equipped as a connection means to the outer casting space element, and the second end region 3.3 (e.g. end-plate or thickening which is larger than the opening of the inner ring 1.3 and where appropriate may be releasably connected to this), on the channel element 3. If no other measures are taken for the sealing of the casting cavity in its inner region, the second end region 3.3 of the channel element 3 and the inner ring 1.3 of the central casting space element 1 are to be designed in a manner such that the end region 3.3 sealingly closes off the opening of the inner ring 1.3 at least for the envisaged casting mass.

The hearing aid in its preliminary condition, that is to say with the elements 1 to 3 assembled together, is shown in FIG. 1 to the right of the elements 1 to 3. The represented hearing aid has already been adapted to the auditory canal by way of a suitable bending of the central part 3.1 of the channel element 3 with respect to the relative position of the inner and outer end-face. The outer casting space element 2 is positioned on or in the outer ring 1.2 of the central casting space element 1; the second end region 3.3 of the channel element 3 is positioned on or in the inner ring 1.3; and the first end region 3.2 of the channel element 3 is locked on the outer casting space element 2 (positive-fit, releasably snap connection).

Advantageously at least the outer ring 1.2 and the outer casting space element 2 comprise further cooperating positive-fit means, with whose help the outer casting space element 2 is fastened in or on the outer ring 2.1 and where appropriate also the rotational position of the two elements relative to one another is defined. The positive-fit means for such a connection are represented in FIG. 1 as recesses in the ring 1.2 and corresponding integral formations on the outer casting space element 2, wherein the integral formations and recesses are dimensioned such that they form a snap closure. Corresponding connection means may also be provided between the inner ring 1.3 and the second end region 3.3 of the channel element 3. Such a connection may be designed in a manner such that it is sealed for the casting mass. Further measures for increasing this sealing are described further below in combination with FIG. 3.

The hearing aid in its preliminary condition is positioned in the auditory canal of a patient. In a suitable manner a press which is not shown is connected to the casting opening 2.1, with which a casting mass is pressed into the casting cavity 5. At the same time advantageously a type of riser is arranged on the bleeding opening 2.2 and into which the casting mass rises when the casting cavity 5 is completely filled, and in which the rising height of the casting mass may be read off as an indicator for the casting pressure. It is also possible the omit the bleeding opening 2.2 and to accordingly design the connection between the outer ring 1.2 and the outer casting element 2 in a manner which is air-permeable but is sealing with regard to the casting mass.

After the solidification of the casting mass pressed into the casting cavity 5, the outer casting space element 2 and the channel element 3 are removed. The individualised part of the hearing aid remains, which only consists of the cast shape body 7 and the central casting space element 3. For completing the hearing aid the electronics module 4 or 4' is assembled into this individualised part, for example by way of a connection which is identical to the connection to the outer casting space element 2 (elastic snap connection).

The electronics module 4 or 4' for example comprises a battery compartment 4.1 with a battery, a microphone 4.2 which is directed towards the outer end-face, an amplifier chip 4.3 and a loudspeaker 4.4 directed towards the inner end-face, as well as the corresponding wiring (not shown). The loudspeaker 4.4 as has already been indicated further above is either integrated in the electronics module (module 4) in a rigid manner or is arranged in a loudspeaker continuation 4.5 (module 4'), wherein the loudspeaker continuation 4.5 by way of bending may be aligned differently with respect to the rest of the module. If an electronics module 4' with a loudspeaker continuation 4.5 is used, by way of a suitable design of the channel elements 3 one must ensure that a region of the loudspeaker channel 4 which is kept free, said region being directed towards the inner end-face of the device, runs in a straight line according to the loudspeaker 4.4. The corresponding region of the channel element 3 may thus not be bent.

As has already been discussed above, instead of the electronics module 4 or 4' one may use another module serving a different function, for example a protective module. Such a protective module as the electronics module 4 or 4' must for example be capable of being snapped on the outer ring 1.2 and it must seal the loudspeaker channel 8 to the outside. The other module therefore on its side facing the cast shape body 7 must have essentially the same shape as the one or the other of the electronics modules 4 or 4' represented in FIG. 1.

Two finished hearing aids 6 and 6' are shown in FIG. 1 to the far right. These comprise a shape body 7 which is cast into the casting cavity 5, whose peripheral surface is tensioned over by the membrane 1.1 and in its contour is adapted exactly to the auditory canal of the wearer. The outer casting space element 2 and the channel element 3 are removed and the outer casting space element is replaced by the electronics module. The device 6 comprises a loudspeaker which is rigidly integrated into the electronics module 4, and a loudspeaker channel 8 which extends between the inner end face and the output side of the loudspeaker 4.4 and which has a bending which is adapted to the individual auditory canal. The device 6' likewise comprises an individually bent loudspeaker channel 8 into which the suitably bent loudspeaker continuation 4.5 of the electronics module 4' is inserted in a manner such that the output side of the loudspeaker 4.4 is positioned as close as possible to the eardrum.

Figure 2:
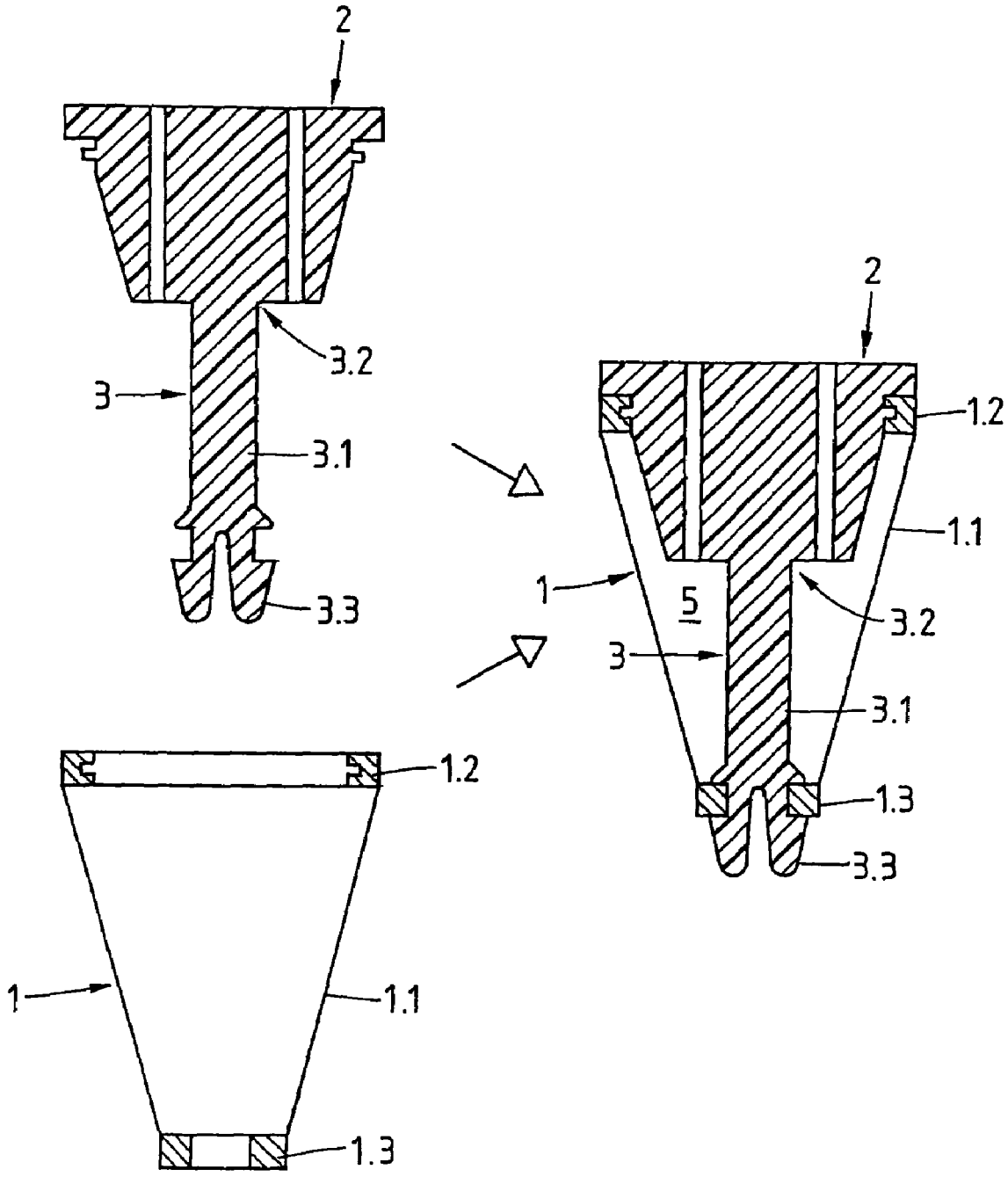
FIG. 2 a schematic diagram of the manufacture of a further, exemplary embodiment of the hearing aid according to the invention (preliminary condition) from a set with two elements (sectioned parallel to the axis)

FIG. 2 in the same manner as FIG. 1 (left part) shows a further exemplary embodiment of the hearing aid according to the invention. In particular the elements of the hearing aid are shown in its preliminary condition and specifically individually (left) and in the assembled together condition (right). The same elements have been provided with the same reference numerals as in FIG. 1. In contrast to the embodiment according to FIG. 1 in which the device in its preliminary form consists of three elements, in FIG. 2 there are only two elements: a central casting space element 1 and an outer casting space element 2.

The channel element 3 in its first end region 3.2 is arranged firmly connected on the outer casting space element 2, and in its second region 3.3 has a shape which is adapted to the inner ring 1.3 of the central casting space element 1 in a manner such that this end region closes the opening of the ring 1.3 and limits the ring 1.3 in its axial position (definition of the axial length of the device in its definitive form). The second end region 3.3 of the channel element for example is a compressible thickening as is shown, which may be snapped into the ring 1.3, wherein a movement of the ring 1.3 toward the outer casting space element 2 may be prevented by way of a further inner thickening. If no other provisions are made for the sealing of the casting cavity, the snap connection between the channel element 3 and the inner ring 1.3 are to be designed in a manner which is suitable for this sealing.

Figure 3:
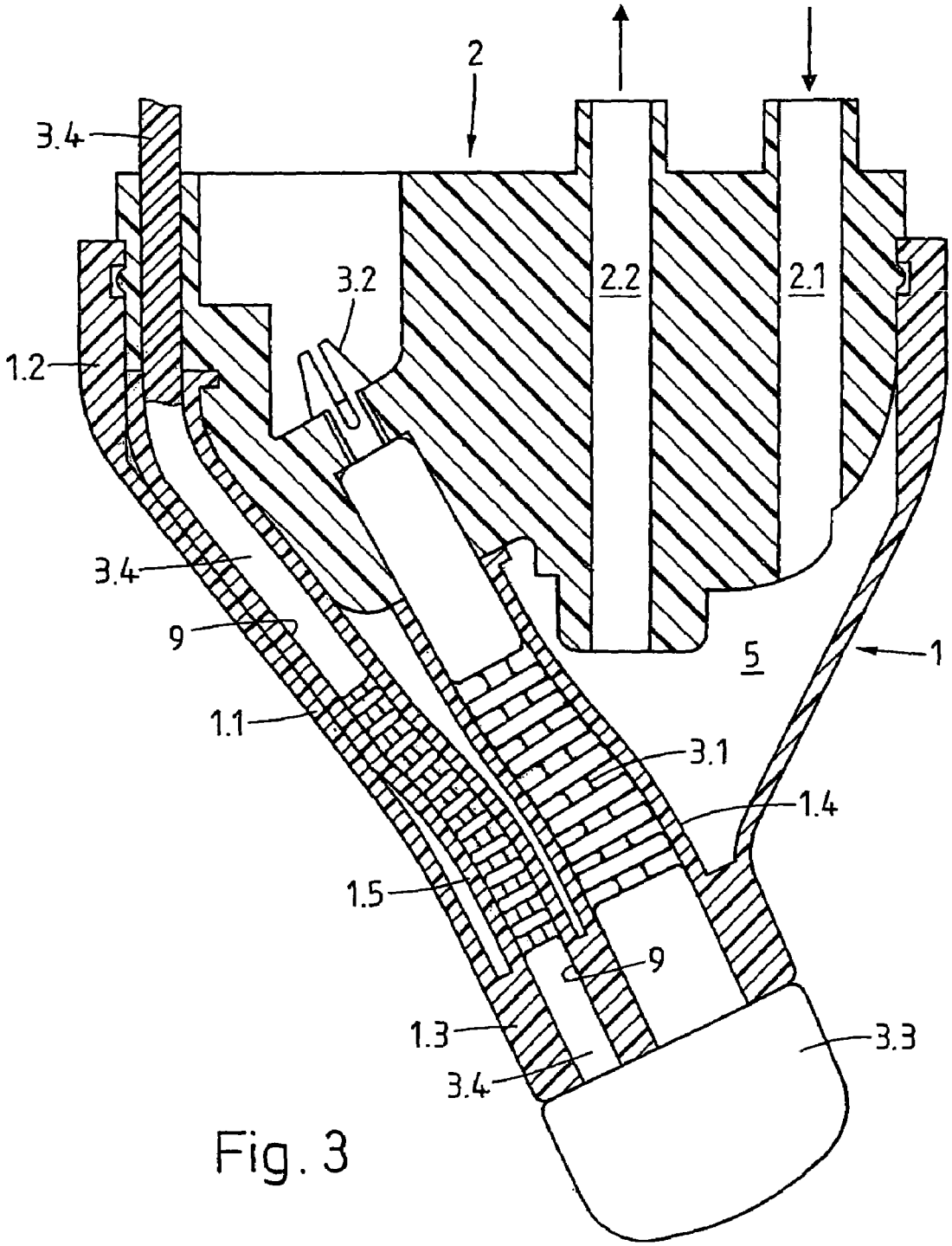
FIG. 3 a further exemplary embodiment of the hearing aid according to the invention in its preliminary condition (three-dimensional, partly sectioned representation)

FIG. 3 in a partly sectioned three-dimensional representation shows a further exemplary embodiment of the hearing aid according to the invention in its preliminary condition. The device is of the same type as the device according to FIG. 1. The same parts are indicated with the same reference numerals as in the FIGS. 1 and 2. In contrast to the device according to FIG. 1, the device according to FIG. 3 comprises a double channel element, wherein the loudspeaker channel part (3.1/2) is designed as is represented in FIG. 1, and the further part (vent channel part 3.4, likewise at least partly bendable) serves for keeping free a vent channel. The second end region 3.3 serves both channel element parts. For the vent channel 3.4 a suitable opening is provided in the outer casting space element 2 (and accordingly in the electronics module) or in the outer ring 1.2 and in the inner ring 1.3.

For improving the sealing of the casting cavity 5 in the region of the inner end-face of the device, the central casting space element 1 in each case comprises a flexible tube 1.4 and 1.5 for accommodating the two channel elements 3.1/2 and 3.4. These flexible tubes are fastened on the inner ring 1.3 and have a length which is somewhat larger than the corresponding distance to the other casting space element. If the channel element parts 3.1/2 and 3.4 are introduced into the flexible tubes 1.4 and 1.5 and the loudspeaker channel part 3.1/2 is connected to the outer casting space element 2, the flexible tubes 1.4 and 1.5 are compressed somewhat and by way of this are pressed against the outer casting element 2, which contributes to the sealing between the flexible tube 1.4 and 1.5 and the outer casting space element 2.

The flexible tubes 1.4 and 1.5 also permit the two channel element parts 3.1/2 and 3.4 not to have to be designed in a rod-shaped manner as shown in FIG. 1 but in the form of displacing columns. This shape also permits a heavy bending of the continuations without a change of the cross section of the channel to be kept free.

Additionally the flexible tubes 1.4 and 1.5 have the effect that the loudspeaker and the vent channel have a minimal distance to the peripheral surface of the device (in its definitive condition).

The central casting space element 1 of the embodiment of the hearing aid according to the invention, as is shown in its preliminary condition in FIG. 3, must have various material properties at different locations. The membrane 1.1 must be expandable to a great extent. The outer ring 1.2 and the inner ring 1.3 must be elastic and shape-stable. The flexible tubes 1.4 and 1.5 must be flexible. It has been shown that such a central casting space element 1 may be advantageously manufactured out of for example three different materials by way of injection moulding technology, in a manner such that the individual regions are cast onto one another and the casting space element, after the last casting step, may be removed from the injection mould in its entirety. It is however also possible to manufacture the central casting space element 1 in that the parts of different materials are bonded or welded onto one another or that in particular the connection between the rings 1.2 and 1.3 and the membrane 1.1 is realised as a clamping connection.

One exemplary injection moulding method for manufacturing the central casting space element 1 has the following steps:

casting the outer ring 1.2 and the inner ring 1.3 for example of polyamide, LCP (liquid crystal polymer), polyetherether-ketone (PEEK) or a suitable silicone material (wall thickness: 0.1 to 1.5 mm);

applying the inner ring 1.3 in a further mould and casting the flexible tubes 1.4 and 1.5 for example of a moderately expandable silicone material (e.g. addition-or condensation-cross-linked 2-component silicone) or of a thermoplastic elastomer onto the ring (wall thickness: 0.1 to 1.5 mm);

applying the outer ring 1.2 and the inner ring 1.3 with the flexible tubes 1.4 and 1.5 connected thereto in a further mould and for example casting from a greatly expandable silicone material (e.g. addition-or condensation-cross-linked 2-component silicone) or thermoplastic elastomer (wall thickness: 0.05 to 0.5 mm).

Advantageously the casting mass for casting the shape body is adapted to the material of the membrane and the flexible tubes in a manner such that the two materials assume a connection. With the use of the above-mentioned silicone materials for the membrane and the flexible tubes, the casting mass is advantageously a cold-cross-linking silicone material. The casting mass may however also be polyurethane or another material which is curable as rapidly as possible.

Figure 4:
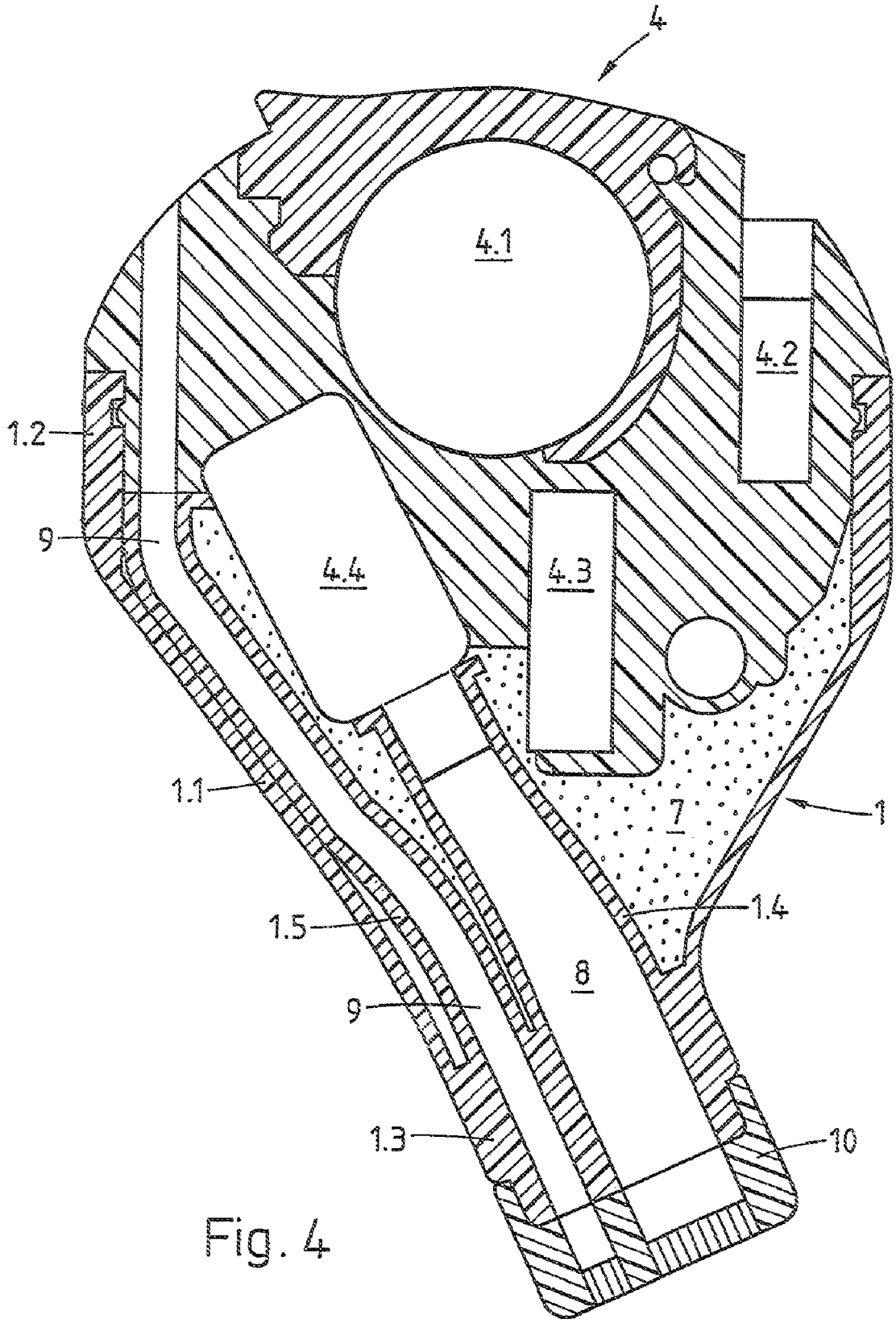
FIG. 4 the hearing aid according to FIG. 3 in its definitive condition (section parallel to the axis)

FIG. 4 shows the hearing aid according to FIG. 3 in its definitive condition. The electronics module 4 is snapped in the outer ring 1.2 in place of the outer casting space element. The electronics module 4 and the outer casting space element are matched to one another in a manner such that the output side of the loudspeaker 4.4 in the snapped-in electronics module is directed into the flexible tube 1.4. The vent channel 9 which is kept free by way of the vent-channel part 3.4 of the channel element 3 and the flexible tube 1.5 extends axially through the whole device.

In the regions of the inner end-face of the hearing aid according to FIG. 4, a cerumen protection cap 10 adapted in its shape to the second end region of the channel element may be placed on. Where appropriate, suitable connection means (not shown) may be provided for this on the inner ring 1.3, and by way of these means also the mentioned end region of the channel element may be fastened on the inside of the ring 1.3.

Figure 5:
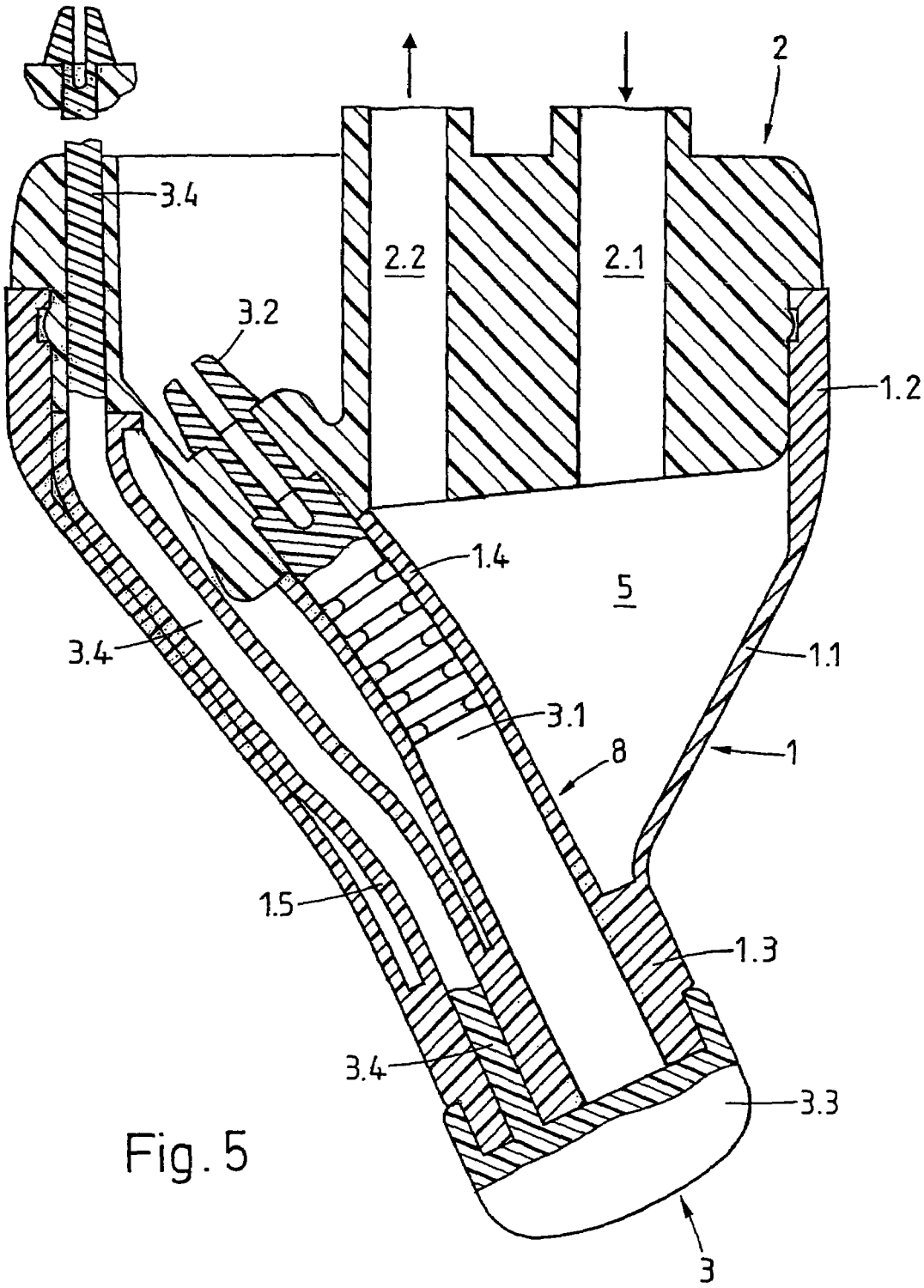
FIG. 5 a further exemplary embodiment of the hearing aid according to the invention in its preliminary condition (section parallel to the axis)

FIG. 5 shows a further exemplary embodiment of the hearing aid according to the invention in its preliminary condition, that is to say with a casting cavity 5. This device differs from the device according to FIGS. 3 and 4 to the extent that the part of the loudspeaker channel 8, said part facing the inner device side, is adapted to the loudspeaker, which means in particular that it is not bent. This is realised with a loudspeaker channel part of the channel element 3 whose central region 3.1 is not deformable on the corresponding location but at a location facing the outer casting space element 2.

Figure 6:
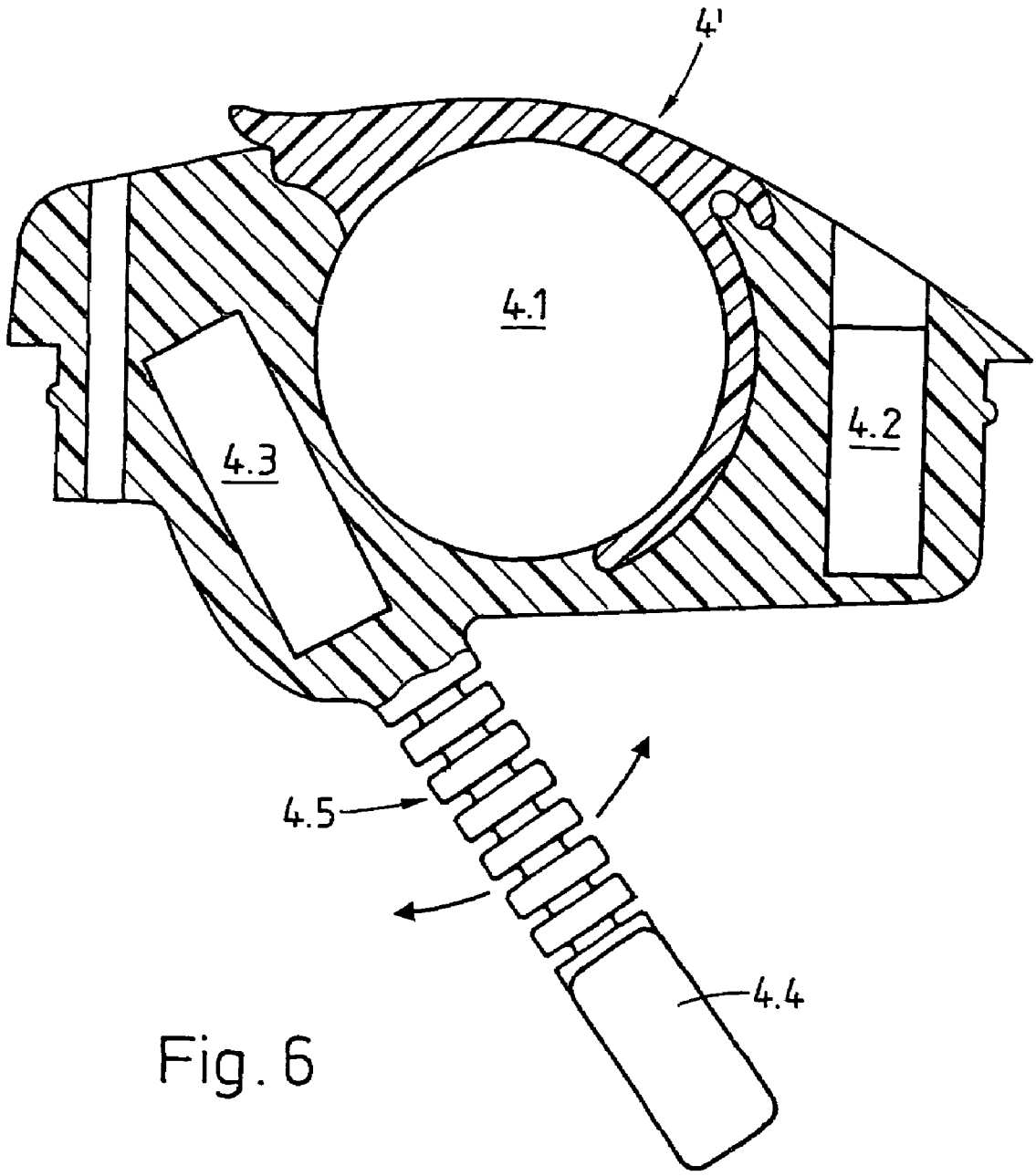
FIG. 6 an exemplary electronics module for the hearing aid according to FIG. 5.

FIG. 6 shows an electronics module 4' which after the casting procedure may be applied in the hearing aid according to FIG. 5. The loudspeaker of this electronics module 4' is arranged at the distal end of a loudspeaker continuation 4.5 whose proximal region is bendable as the corresponding part of the channel element 3.

As is deduced from the FIGS. 5 and 6, the loudspeaker 4.4 of the electronics module 4' applied into the individualised part (central casting space element and cast shape body) is positioned in the loudspeaker channel kept free by the loudspeaker channel part 3.1/2 and by the flexible tube 1.4, wherein its output side is positioned in the region of the inner ring 1.3.

While the invention has been described in detail above with reference to some embodiments, variations within the scope and spirit of the invention will be apparent to those of ordinary skill in the art. Thus, the invention should be considered as limited only by the scope of the appended claims.

The invention claimed is:

1. A set for the manufacture of a hearing aid which by way of casting a shape body in a specific auditory canal is adapted to this auditory canal, wherein the hearing aid in a preliminary condition comprises a casting cavity, and in the adapted, definitive condition comprises the cast shape body, said set comprising the following constituents:

a central casting space element with an inner and outer ring and a flexible-tube-like and expandable membrane which extends between the two rings and which radially delimits the casting cavity to the outside, an outer casting element with a casting opening, said element being matched to the outer ring and closing off the casting cavity to the outside, an at least partly bendable channel element with a first end region and with a second end region, wherein the first end region is firmly connected or releasably connectable to the outer casting space element, and the second end region is matched to the inner ring of the central casting space element in a manner such that by way of this second end region, the opening of the inner ring may be essentially closed and the axial movability of the inner ring may be limited;

an electronics module with a loudspeaker, serving an acoustic function and/or another module serving a different function, wherein the inner side of the outer casting space element is adapted to the corresponding inner side of the electronics module and/or the other module, in a manner such that the position of the fixed or releasable connection between the outer casting space element and the first end region of the channel element corresponds to the position of the output side of the loudspeaker or of an at least partly bendable loudspeaker continuation of the electronics module, said continuation carrying the loudspeaker, and/or corresponds to the position of an equally shaped part of the other module.

2. A set according to claim 1, wherein the channel element in its first end region is firmly connected to the outer casting space element and the second end region of the channel element is formed as a compressible thickening which may be moved through the inner ring of the central casting space element.

3. A set according to claim 1, wherein the channel element in its first end region is releasably connectable to the outer casting space element and the second end region of the channel element is designed as a thickening which may not move through the inner ring of the central casting space element.

4. A set according to claim 1, wherein the outer ring of the central casting space element on the one hand and the outer casting space element or the electronics module and/or the other module on the other hand comprise connection means cooperating with one another, for creating a releasable connection between the central casting space element on the one hand and the outer casting space element or electronics module and/or another module on the other hand.

5. A set according to claim 1, wherein at least one of the releasable connections between the channel element and the outer casting space element, between the outer ring and the electronics module and/or another module or between the channel element and the inner ring of the central casting space element is a releasable snap connection.

6. A set according to claim 4 wherein the releasable connection between the outer ring of the central casting space element and the outer casting space element is air-permeable and is impermeable to a casting mass.

7. A set according to claim 3, wherein a likewise bendable vent channel part for keeping free a vent channel is arranged on the second end region of the channel element which is releasably connectable to the outer casting space element.

8. A set according to claim 1, wherein the central casting space element for the loudspeaker channel, or for the loudspeaker channel and the vent channel comprises a flexible tube which is fastened on the inner ring.

9. A set according to claim 1, wherein the central casting space element consists of several different materials.

10. A set according to claim 9, wherein the parts of the central casting element which consist of different materials are cast onto one another by way of injection moulding.

11. A set according to claim 9, wherein the outer and the inner ring consists of polyamide, liquid crystal polymer, polyetherether-ketone or a silicone material and that the membrane, or the membrane and the flexible tubes consist of a silicone material or a thermoplastic elastomer.

12. A method for manufacturing a hearing aid from a set according to claim 1, said method comprising the following steps:

creating the hearing aid in its preliminary condition in that the outer casting space element is placed onto or into the outer ring of the central casting space element and the channel element essentially closes the opening of the inner ring of the central casting element, limits the movability of the inner ring and is connected to the outer casting space element;

positioning the hearing aid in its preliminary condition in an auditory canal;

filling the casting cavity with a casting mass and letting the casting mass cure;

removing the hearing aid from the auditory channel;

removing the outer casting space element and the channel element;

positioning the electronics module or another module at the location of the outer casting space element.

13. A hearing aid which at least partly is to be worn in an auditory canal, said hearing aid comprising an individual part and an electronics module or another module, which is releasably connected to the individual part, wherein the individual part comprises a cast shape body adapted to the auditory canal, with a membrane extending over its peripheral surface from an outer ring to an inner ring, and a loudspeaker channel bent adapted to the auditory canal, and wherein a loudspeaker is arranged in the electronics module in a manner such that an output side of the loudspeaker which is integrated in the electronics module or is arranged on a bendable loudspeaker continuation, or an equally shaped part of the other module is positioned in the loudspeaker channel of the individual part when the individual part is connected to the electronics module or the other module.

14. A hearing aid according to claim 13, wherein the connection between the individual part and the electronics part or the other module is a releasable snap connection, wherein a connection means is arranged on the outer ring and a connection means cooperating with it is arranged on the electronics module or another module.

15. A hearing aid according to claim 13, wherein a flexible tube surrounding the loudspeaker channel is fastened on the inner ring.

16. A hearing aid according to claim 13, which comprises a vent channel and a flexible tube surrounding the vent channel is fastened on the inner ring.

17. A hearing aid according to claim 13, wherein the outer ring, the inner ring, the membrane and the flexible tubes consist of two or three different materials.

18. A hearing aid according to claim 17, wherein the outer and the inner ring consist of polyamide, liquid crystal polymer, polyether etherketon or a silicone material, and the membrane, or the membrane and the flexible tubes consist of a silicone material or of a thermoplastic elastomer.

19. A hearing aid according to claim 18, wherein the shape body is cast of a cold-cross-linking silicone material which connects to the silicone material of the membrane and of the flexible tubes.

* * * * *